US011375750B2

(12) United States Patent
Liu et al.

(10) Patent No.: US 11,375,750 B2
(45) Date of Patent: Jul. 5, 2022

(54) ATOMIZER AND ELECTRONIC CIGARETTE THEREOF

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Hong Yu, Hunan (CN); Yuangang Dai, Hunan (CN); Xinqiang Yin, Hunan (CN); Jianhua Yi, Hunan (CN); Lizhou Shen, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 550 days.

(21) Appl. No.: 16/343,658

(22) PCT Filed: Oct. 17, 2017

(86) PCT No.: PCT/CN2017/106499

§ 371 (c)(1),
(2) Date: Apr. 19, 2019

(87) PCT Pub. No.: WO2018/072676

PCT Pub. Date: Apr. 26, 2018

(65) Prior Publication Data

US 2019/0274360 A1 Sep. 12, 2019

(30) Foreign Application Priority Data

Oct. 20, 2016 (CN) ..... 201621140373.X

(51) Int. Cl.
*A24F 40/40* (2020.01)
*A24B 15/167* (2020.01)
(Continued)

(52) U.S. Cl.
CPC ..... *A24F 40/40* (2020.01); *A24B 15/167* (2016.11); *A24F 40/44* (2020.01); *A24F 40/46* (2020.01); *A24F 40/10* (2020.01); *A24F 40/485* (2020.01)

(58) Field of Classification Search
None
See application file for complete search history.

(56) References Cited

U.S. PATENT DOCUMENTS

2013/0284192 A1 10/2013 Peleg et al.
2017/0079332 A1* 3/2017 Li ..... A24F 40/51

FOREIGN PATENT DOCUMENTS

CN 103380952 A 11/2013
CN 103519350 A 1/2014
(Continued)

OTHER PUBLICATIONS

International Search Report issued in International Application No. PCT/CN2017/106499 dated Jan. 16, 2018, 4 pages.

*Primary Examiner* — Michael J Felton
*Assistant Examiner* — Katherine A Will
(74) *Attorney, Agent, or Firm* — Mauriel Kapouytian Woods LLP; Tzvi Hirshaut; Michael Mauriel

(57) ABSTRACT

Disclosed is an atomizer, comprising an atomizer body, a suction nozzle assembly, an air inlet, an atomization sheet, a tobacco tar chamber, a tobacco tar guide device and an air outflow passage, in which a tobacco tar separation chamber is provided in the middle of the tobacco tar chamber and an accommodating chamber is provided in the tobacco tar separation chamber.

14 Claims, 5 Drawing Sheets

(51) Int. Cl.

| | |
|---|---|
| ***A24F 40/44*** | (2020.01) |
| ***A24F 40/46*** | (2020.01) |
| *A24F 40/10* | (2020.01) |
| *A24F 40/485* | (2020.01) |

(56) References Cited

FOREIGN PATENT DOCUMENTS

| | | | |
|---|---|---|---|
| CN | 105559151 | A | 5/2016 |
| CN | 105795527 | A | 7/2016 |
| CN | 105876870 | A | 8/2016 |
| CN | 206119183 | U | 4/2017 |

* cited by examiner

ATOMIZER AND ELECTRONIC CIGARETTE THEREOF

CROSS REFERENCE TO RELATED APPLICATIONS

This application is a national phase application of international application number PCT/CN2017/106499 filed on Oct. 17, 2017, which claims priority to Chinese application number 201621140373.X filed on Oct. 20, 2016.

FIELD OF THE INVENTION

The present invention belongs to an atomizer and an electronic cigarette thereof.

BACKGROUND OF THE INVENTION

At present, the existing ultrasonic high-frequency atomizing electronic cigarette generally transfers tobacco tar in a tobacco tar chamber to an atomization sheet through tobacco tar guide cotton, and then atomizes the tobacco tar by high-frequency oscillation through an air inflow passage and an air outflow passage communicated with the atomization surface of the atomization sheet. However, the existing product has the following defects in practical application:

1. The air outflow passage is far away from the atomization surface. When air passes through the air inflow passage and will flow to the atomization surface, the entering air is disordered, not all air flows to the atomization surface to participate in atomization, and some cold air directly flows away from the air outflow passage, so that the smoke cannot be carried out very well, and the atomization efficiency and the amount of smoke are greatly reduced. At the same time, the cold air mixed up with atomized smoke lowers the temperature of the smoke, so that the temperature of the smoke entering the mouth is low and the mouthfeel is poor.

2. The heat generated by the atomization sheet is easily transferred to a shell through the air outflow passage, causing the shell to be very hot.

3. The surface of the atomization sheet is prone to tobacco tar accumulation. Especially when the electronic cigarette is not used for a long time, the tobacco tar continuously penetrates down, which easily causes tobacco tar accumulation. As a result, the tobacco tar is difficult to atomize, and the amount of discharged smoke is small.

SUMMARY OF THE INVENTION

In view of the above problems, the present invention is intended to provide an atomizer which prevents a shell from being hot, has high atomization efficiency, generates a large amount of smoke and does not accumulate tobacco tar, and an electronic cigarette thereof.

The technical solution for solving the problems of the present invention is: an atomizer, comprising an atomizer body, a suction nozzle assembly mounted at the top of the atomizer body, an air inlet provided in the atomizer body, an atomization sheet and a tobacco tar chamber provided in the atomizer body, and a tobacco tar guide device which guides tobacco tar in the tobacco tar chamber to the atomization surface of the atomization sheet, wherein an air outflow passage communicated with the suction nozzle assembly is provided in the atomizer body, a tobacco tar separation chamber is provided in the middle of the tobacco tar chamber, and an accommodating chamber is provided in the tobacco tar separation chamber;

the air outflow passage comprises an air duct arranged in the accommodating chamber, a first gap is reserved between the outer wall of the air duct and the inner wall of the accommodating chamber, and the first gap communicates with the air inlet to form a first air inflow passage;

the tobacco tar guide device comprises atomization cotton, which is fixed in the accommodating chamber, can guide the tobacco tar to the atomization sheet, abuts against the atomization surface of the atomization sheet and is of a hollow cylindrical structure;

a thermal insulation pipe is sleeved on the lower part of the air duct, the upper part of the air duct communicates with the suction nozzle assembly, the lower part of the air duct is inserted into the hollow chamber of the atomization cotton, a second gap is reserved between the lower end of the thermal insulation pipe and the bottom of the hollow chamber of the atomization cotton, and the second gap communicates with the first air inflow passage.

Further, the length of the second gap which is between the lower end of the thermal insulation pipe and the bottom of the hollow chamber of the atomization cotton is 0.2 to 0.7 mm.

In the above solution, the thermal insulation pipe is near the atomization cotton, air can be guided to enter in order, thus all the air can pass over, at a low level, the contact surface of the atomization cotton and the atomization sheet through the small gap, and flow to the atomization surface to participate in atomization, so that the atomization is more complete, the atomization efficiency is higher, and more smoke is generated. The thermal insulation pipe can insulate heat, thereby preventing the heat generated by the atomization sheet from being transferred to the shell through the air duct.

Further, the atomizer body comprises a shell and a connection electrode mounted at the bottom of the shell, the suction nozzle assembly is mounted at the top of the shell, and the atomization sheet is electrically connected to the connection electrode.

Specifically, the accommodating chamber is composed of an outer sleeve and an inner sleeve sleeved in the inner chamber of the outer sleeve, the outer sleeve comprises a hollow seal holder arranged at the bottom of the tobacco tar chamber to seal the tobacco tar chamber and a vertical pipe fixed on the seal holder, the inner sleeve is sleeved in the inner chamber of the vertical pipe, and the inner chamber of the inner sleeve is the accommodating chamber;

an atomization sheet fixing holder is arranged in the hollow chamber of the seal holder, and the atomization sheet is fixed on the atomization sheet fixing holder;

the side wall of the atomization cotton is sandwiched and fixed between the outer wall of the inner sleeve and the inner wall of the vertical pipe, and the bottom of the atomization cotton abuts against the atomization sheet; the lower part of the vertical pipe is provided with a plurality of tobacco tar through holes, the tobacco tar through holes are at positions corresponding to the side wall of the atomization cotton, and the tobacco tar through holes communicate with the tobacco tar chamber;

the air duct with the thermal insulation pipe is inserted into the hollow chamber of the inner sleeve as well as the hollow chamber of the atomization cotton.

Further, tobacco tar storage cotton is sleeved at a position, corresponding to the tobacco tar through holes, on the outer wall of the vertical pipe, and the tobacco tar storage cotton is located in the tobacco tar chamber and covers the tobacco tar through holes. The tobacco tar storage cotton can control the tobacco tar transfer rate and prevent the atomization cotton from absorbing too much tobacco tar to produce tobacco tar accumulation.

In order to ensure closer contact between the atomization cotton and the atomization sheet, the lower part of the inner chamber of the inner sleeve is sleeved with a spring, the lower end of the spring abuts against the inner surface of the bottom of the atomization cotton, and the air duct with the thermal insulation pipe is inserted into the hollow chamber of the inner sleeve as well as a central hole of the spring.

Further, a thermal insulation sheet is arranged between the lower surface of the atomization sheet and the connection electrode. The thermal insulation sheet can prevent the heat of the atomization sheet from being transferred from the lower part to the connection electrode and the shell.

Further, a filter screen is arranged at the joint between the air duct and the thermal insulation pipe. The filter screen is used for preventing tobacco tar from splashing or large particle smoke from being sucked into the user's mouth when the atomization sheet is operated.

Preferably, the inner chamber of the thermal insulation pipe is conical, and the inner diameter of the upper part of the thermal insulation pipe is smaller than the inner diameter of the lower part of the thermal insulation pipe. With this trumpet-shaped design, the pressure of the smoke of the outlet is higher, which is more conducive to the mixing of smoke.

Correspondingly, the present invention also provides an electronic cigarette, comprising an external power source, and further comprising the atomizer according to the above solution, wherein the external power source is connected to the connection electrode of the atomizer.

The significant effects of the present invention are:

1. The thermal insulation pipe is near the atomization cotton, thus air can be guided to enter in order, and all the air can pass over, at a low level, the contact surface of the atomization cotton and the atomization sheet through the small gap, and flow to the atomization surface to participate in atomization, so that the atomization is more complete, the atomization efficiency is higher, and more smoke is generated. Moreover, cold air is prevented from flowing directly from the air duct to be mixed with the smoke to reduce the temperature of the smoke, thereby avoiding the phenomenon that the low temperature of the smoke affects the mouthfeel.

2. The design of the thermal insulation pipe and the thermal insulation sheet can prevent the heat generated by the atomization sheet from being transferred to the shell through the air duct, thereby preventing the shell from being too hot.

3. The tobacco tar storage cotton can store tobacco tar, thereby controlling the tobacco tar transfer rate and preventing the atomization cotton from absorbing too much tobacco tar to accumulate tobacco tar.

BRIEF DESCRIPTION OF THE DRAWINGS

The present invention will be further illustrated below in conjunction with the accompanying drawings.

Figure 1:
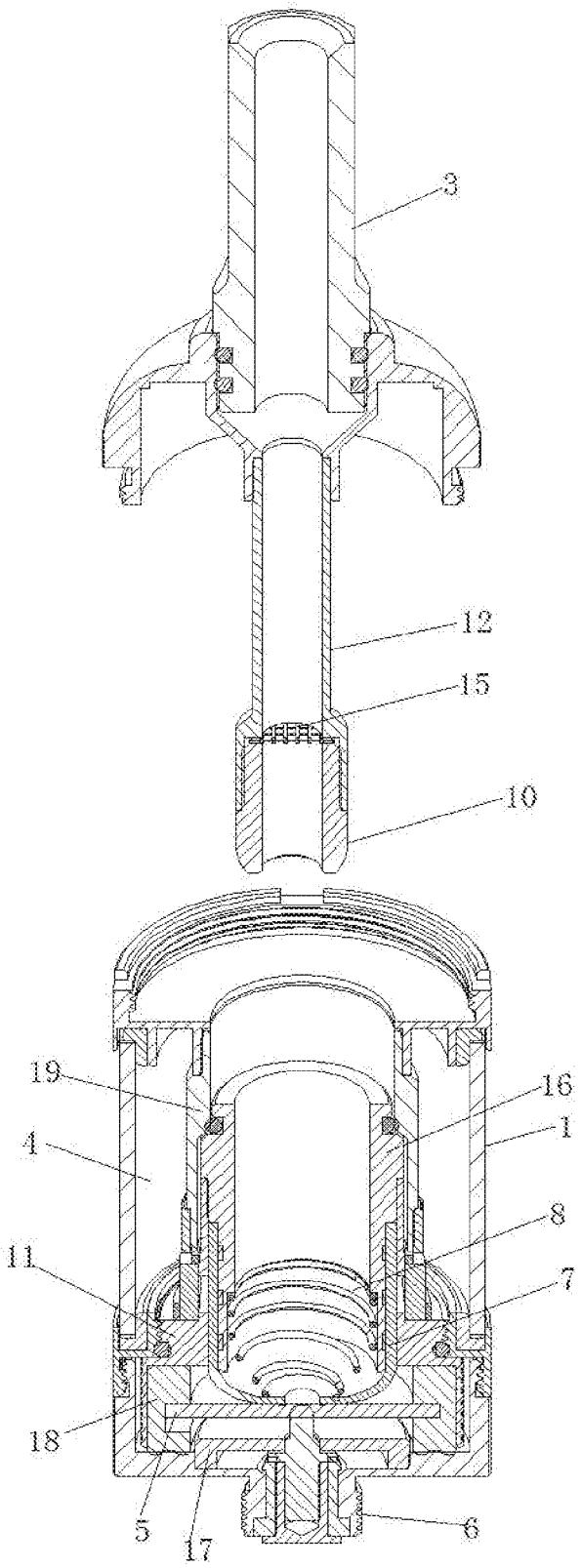
FIG. 1 is an oblique exploded view of an atomizer in embodiment 1.
Figure 2:
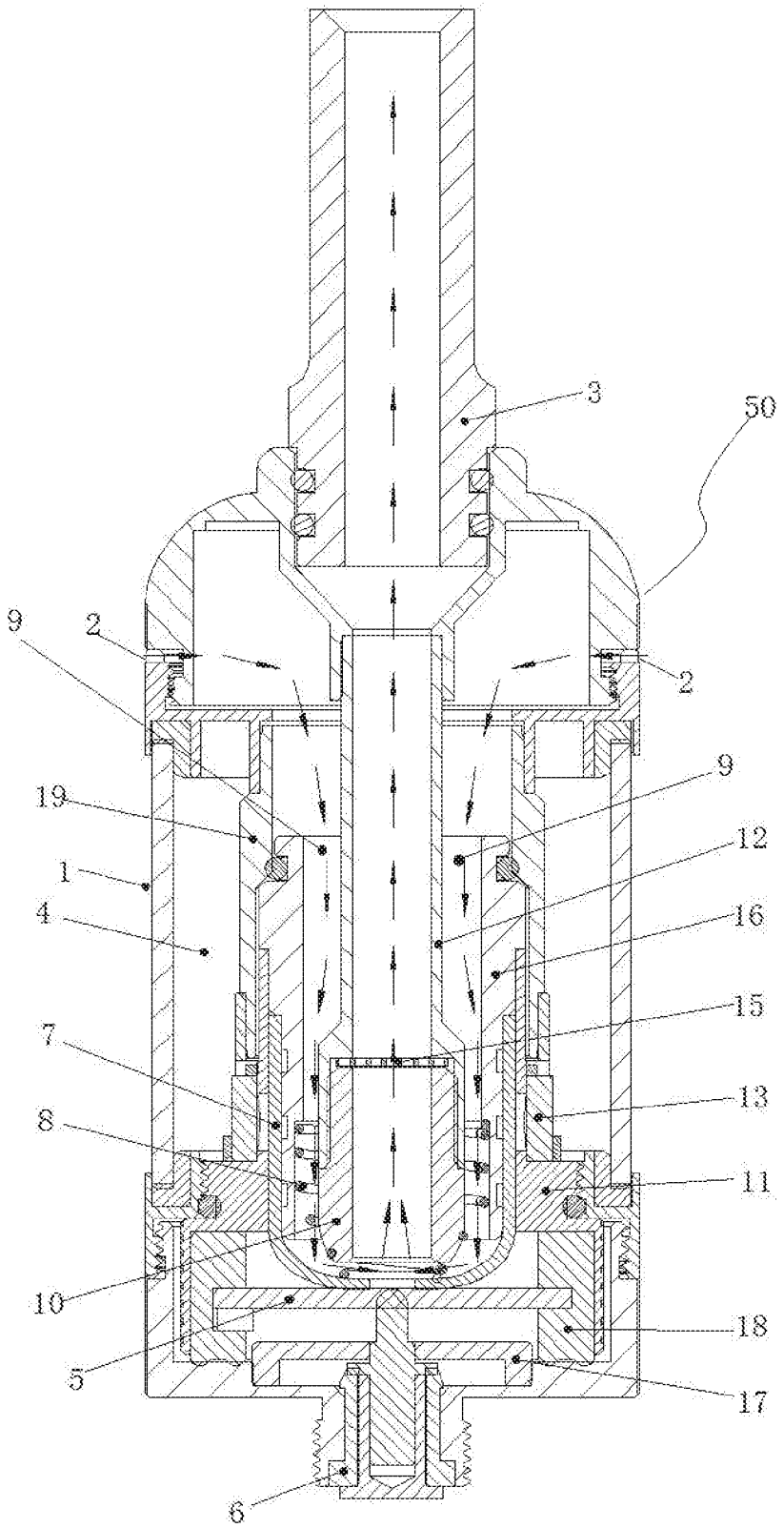
FIG. 2 is a sectional view of embodiment 1.
Figure 3:
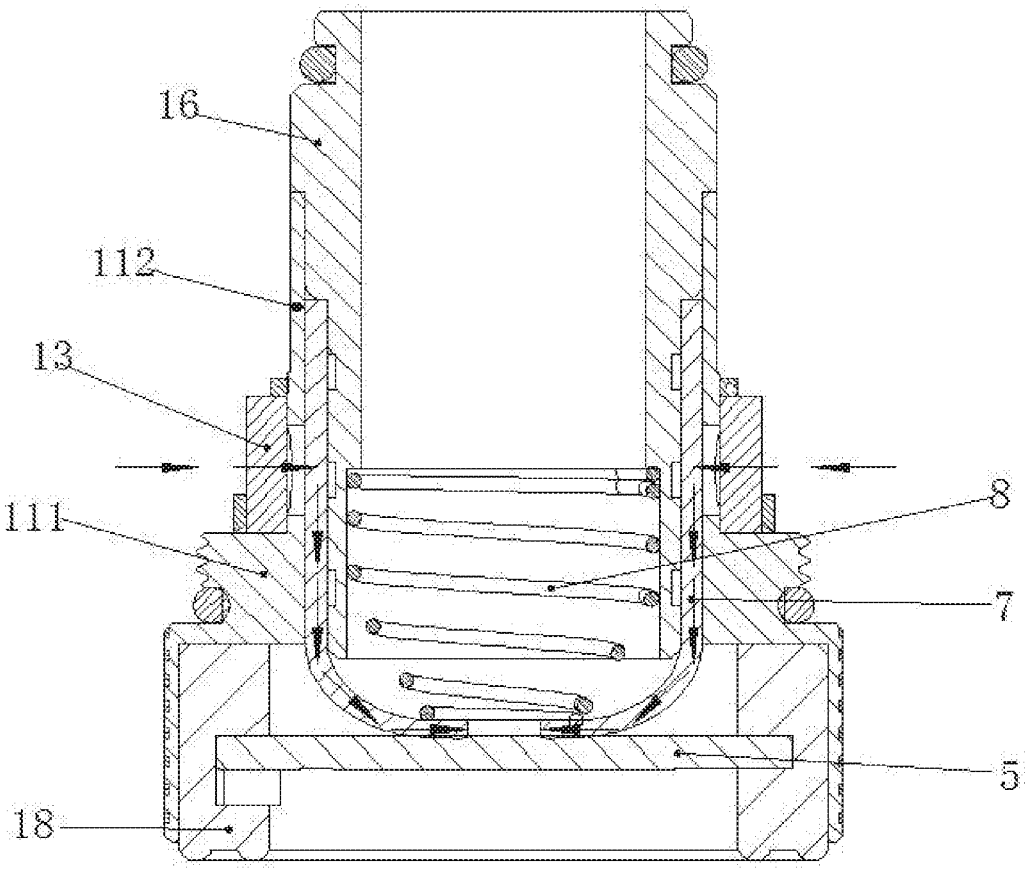
FIG. 3 is a view of an assembly structure of an outer sleeve and an inner sleeve in embodiment 1.
Figure 4:
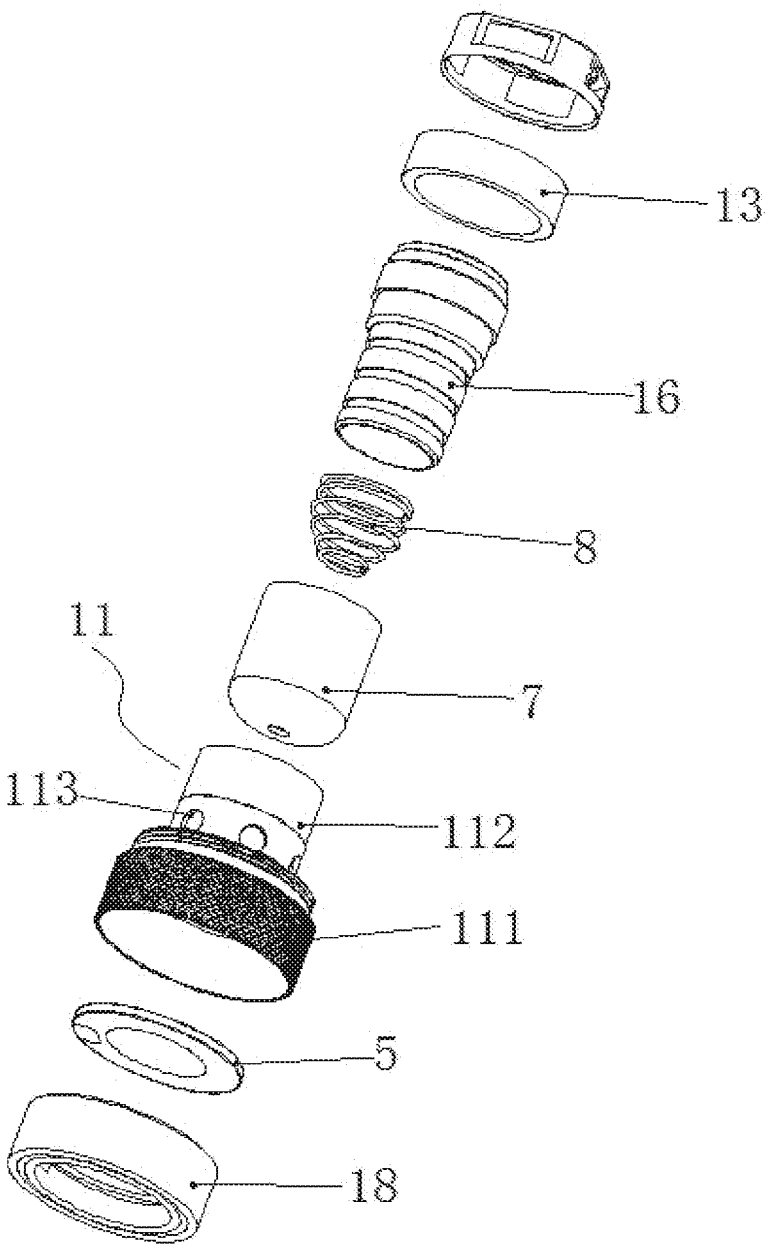
FIG. 4 is an exploded view of the assembly structure of the outer sleeve and the inner sleeve in embodiment 1.

In which: 1—shell, 2—air inlet, 3—suction nozzle assembly, 4—tobacco tar chamber, 5—atomization sheet, 6—connection electrode, 7—atomization cotton, 8—spring, 9—first air inflow passage, 10—thermal insulation pipe, 11—outer sleeve, 12—air duct, 13—tobacco tar storage cotton, 15—filter screen, 16—inner sleeve, 17—thermal insulation sheet, 18—atomization sheet fixing holder, 19—tobacco tar separation chamber, 50—atomizer body, 111—seal holder, 112—vertical pipe, 113—tobacco tar through hole.

DETAILED DESCRIPTION OF EMBODIMENTS

Embodiment 1

As shown in FIGS. 1 to 4, an atomizer, including an atomizer body 50, and the atomizer body 50 includes a shell 1, an air inlet 2 at the upper part of the shell 1, a suction nozzle assembly 3 mounted at the top of the shell 1, a tobacco tar chamber 4 and an atomization sheet 5 arranged in the shell 1, a tobacco tar guide device which guides tobacco tar in the tobacco tar chamber 4 to the surface of the atomization sheet 5, and a connection electrode 6 mounted at the bottom of the shell 1.

An air outflow passage communicated with the suction nozzle assembly 3 is provided in the shell 1, the air outflow passage includes an air duct 12 arranged in the inner chamber of the shell, a tobacco tar separation chamber 19 is provided in the middle of the tobacco tar chamber 4, an accommodating chamber is provided in the tobacco tar separation chamber 19, the air duct 12 is arranged in the accommodating chamber, a first gap is reserved between the outer wall of the air duct 12 and the inner wall of the accommodating chamber, and the first gap communicates with the air inlet 2 to form a first air inflow passage 9.

The accommodating chamber is composed of an outer sleeve 11 and an inner sleeve 16 sleeved in the inner chamber of the outer sleeve 11, and the outer sleeve 11 includes a hollow seal holder 111 arranged at the bottom of the tobacco tar chamber 4 to seal the tobacco tar chamber 4, and a vertical pipe 112 fixed on the seal holder 111. The inner sleeve 16 is sleeved in the inner chamber of the vertical pipe 112, and the inner chamber of the inner sleeve 16 is the accommodating chamber. An atomization sheet fixing holder 18 is arranged in the hollow chamber of the seal holder 111, and the atomization sheet 5 is fixed on the atomization sheet fixing holder 18.

Atomization cotton 7 is sandwiched and fixed between the outer wall of the inner sleeve 16 and the inner wall of the vertical pipe 112, and the atomization cotton 7 is of a hollow cylindrical structure. The bottom of the atomization cotton 7 abuts against the atomization sheet 5. The lower part of the vertical pipe 112 is provided with a plurality of tobacco tar through holes 113, the tobacco tar through holes 113 are at positions corresponding to the side wall of the atomization cotton 7. The tobacco tar through holes 113 communicate with the tobacco tar chamber 4.

Tobacco tar storage cotton 13 is sleeved at a position, corresponding to the tobacco tar through holes 113, on the outer wall of the vertical pipe 112, and the tobacco tar storage cotton 13 is located in the tobacco tar chamber 4 and covers the tobacco tar through holes 113. The lower part of the inner chamber of the inner sleeve 16 is sleeved with a spring 8, and the lower end of the spring 8 abuts against the inner surface of the bottom of the atomization cotton 7.

The lower part of the air duct 12 is sleeved with a thermal insulation pipe 10, and a filter screen 15 is arranged at the joint of the air duct 12 and the thermal insulation pipe 10. The upper part of the air duct 12 communicates with the suction nozzle assembly 3, and the air duct 12 with the thermal insulation pipe 10 is inserted into the hollow chamber of the inner sleeve 16 as well as a central hole of the spring 8. A gap of 0.2 to 0.7 mm is reserved between the lower end of the thermal insulation pipe 10 and the bottom of the hollow chamber of the atomization cotton 7.

The atomization sheet 5 is electrically connected to the connection electrode 6. A thermal insulation sheet 17 is arranged between the lower surface of the atomization sheet 5 and the connection electrode 6. The atomization sheet 5 is preferably a solid piezoelectric ceramic sheet.

The present embodiment further provides an electronic cigarette, including an external power source, and further including an atomizer according to the above solution, wherein the external power source is connected to the connection electrode 6 of the atomizer.

Air enters from the air inlet 2, flows through the first air inflow passage 9, and arrives at the atomization surface from the second gap. The atomized air enters the air duct 12 from the thermal insulation pipe 10, and finally arrives at the suction nozzle assembly 3.

Embodiment 2

Figure 5:
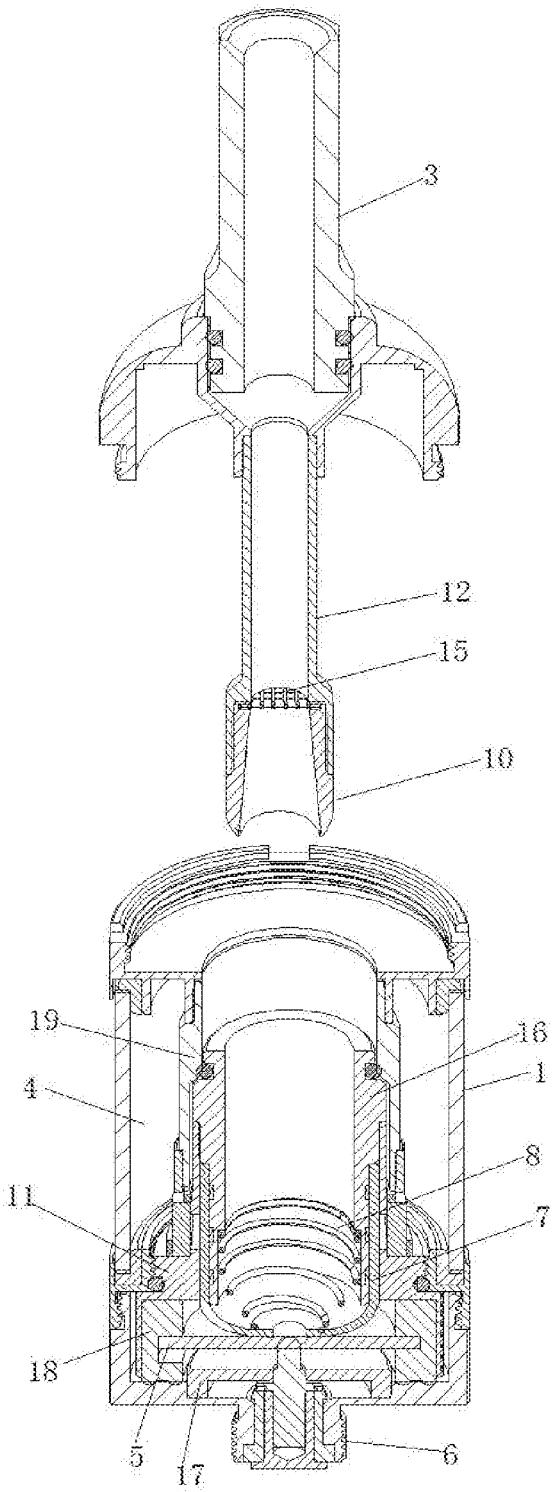
FIG. 5 is an oblique exploded view of an atomizer in embodiment 2.

As shown in FIG. 5, the contents of embodiment 1 is repeated, except that the inner chamber of the thermal insulation pipe 10 is conical, and the inner diameter of the upper part of the thermal insulation pipe 10 is smaller than the inner diameter of the lower part of the thermal insulation pipe 10. With this trumpet-shaped design, the pressure of the smoke of the outlet is higher, which is more conducive to the mixing of smoke.

The invention claimed is:

1. An atomizer, comprising an atomizer body, a suction nozzle assembly mounted at the top of the atomizer body, an air inlet provided in the atomizer body, an atomization sheet and a tobacco tar chamber provided in the atomizer body, and a tobacco tar guide device which guides tobacco tar in the tobacco tar chamber to an atomization surface of the atomization sheet, wherein an air outflow passage communicated with the suction nozzle assembly is provided in the atomizer body, and wherein a tobacco tar separation chamber is provided in the middle of the tobacco tar chamber, and an accommodating chamber is provided in the tobacco tar separation chamber;

wherein the air outflow passage comprises an air duct arranged in the accommodating chamber, a first gap is reserved between the outer wall of the air duct and an inner wall of the accommodating chamber, and the first gap communicates with the air inlet to form a first air inflow passage;

wherein the tobacco tar guide device comprises atomization cotton, which is fixed in the accommodating chamber, can guide the tobacco tar to the atomization sheet, the atomization cotton comprising a hollow cylinder and a bottom that abuts against the atomization surface of the atomization sheet, the hollow cylinder and the bottom defining a hollow chamber of the atomization cotton;

and wherein a thermal insulation pipe is sleeved on the lower part of the air duct, the upper part of the air duct communicates with the suction nozzle assembly, the lower part of the air duct is inserted into the hollow chamber of the atomization cotton, a second gap is reserved between the lower end of the thermal insulation pipe and the bottom of the hollow chamber of the atomization cotton, and the second gap communicates with the first air inflow passage.

2. The atomizer according to claim 1, wherein the length of the second gap which is between the lower end of the thermal insulation pipe and the bottom of the hollow chamber of the atomization cotton is 0.2 to 0.7 mm.

3. The atomizer according to claim 2, wherein the accommodating chamber is composed of an outer sleeve and an inner sleeve sleeved in the inner chamber of the outer sleeve, wherein the outer sleeve comprises a hollow seal holder arranged at the bottom of the tobacco tar chamber to seal the tobacco tar chamber, wherein a vertical pipe is fixed on the seal holder, the inner sleeve is sleeved in the inner chamber of the vertical pipe, and the inner chamber of the inner sleeve is the accommodating chamber;

wherein an atomization sheet fixing holder is arranged in the hollow chamber of the seal holder, and the atomization sheet is fixed on the atomization sheet fixing holder;

wherein a side wall of the atomization cotton is sandwiched and fixed between the outer wall of the inner sleeve and the inner wall of the vertical pipe, and the bottom of the atomization cotton abuts against the atomization sheet, wherein the lower part of the vertical pipe is provided with a plurality of tobacco tar through holes, wherein the tobacco tar through holes are at positions corresponding to the side wall of the atomization cotton, and the tobacco tar through holes communicate with the tobacco tar chamber;

and wherein the air duct with the thermal insulation pipe is inserted into the hollow chamber of the inner sleeve as well as the hollow chamber of the atomization cotton.

4. The atomizer according to claim 2, wherein the inner chamber of the thermal insulation pipe is conical, and the inner diameter of the upper part of the thermal insulation pipe is smaller than the inner diameter of the lower part of the thermal insulation pipe.

5. The atomizer according to claim 1, wherein the atomizer body further comprises a shell and a connection electrode mounted at the bottom of the shell, the suction nozzle assembly is mounted at the top of the shell, and the atomization sheet is electrically connected to the connection electrode.

6. The atomizer according to claim 5, wherein the accommodating chamber is composed of an outer sleeve and an inner sleeve sleeved in the inner chamber of the outer sleeve, wherein the outer sleeve comprises a hollow seal holder arranged at the bottom of the tobacco tar chamber to seal the tobacco tar chamber, and wherein a vertical pipe is fixed on the seal holder, the inner sleeve is sleeved in the inner chamber of the vertical pipe, and the inner chamber of the inner sleeve is the accommodating chamber;

wherein an atomization sheet fixing holder is arranged in the hollow chamber of the seal holder, and the atomization sheet is fixed on the atomization sheet fixing holder;

wherein a side wall of the atomization cotton is sandwiched and fixed between the outer wall of the inner sleeve and the inner wall of the vertical pipe, and the bottom of the atomization cotton abuts against the atomization sheet, wherein the lower part of the vertical pipe is provided with a plurality of tobacco tar through holes, the tobacco tar through holes are at positions corresponding to the side wall of the atomization cotton, and the tobacco tar through holes communicate with the tobacco tar chamber;

and wherein the air duct with the thermal insulation pipe is inserted into the hollow chamber of the inner sleeve as well as the hollow chamber of the atomization cotton.

7. The atomizer according to claim 5, wherein a thermal insulation sheet is arranged between the lower surface of the atomization sheet and the connection electrode.

8. The atomizer according to claim 5, wherein the inner chamber of the thermal insulation pipe is conical, and the inner diameter of the upper part of the thermal insulation pipe is smaller than the inner diameter of the lower part of the thermal insulation pipe.

9. The atomizer according to claim 1, wherein the accommodating chamber is composed of an outer sleeve and an inner sleeve sleeved in the inner chamber of the outer sleeve, wherein the outer sleeve comprises a hollow seal holder arranged at the bottom of the tobacco tar chamber to seal the tobacco tar chamber, wherein a vertical pipe is fixed on the seal holder, the inner sleeve is sleeved in the inner chamber of the vertical pipe, and the inner chamber of the inner sleeve is the accommodating chamber;

wherein an atomization sheet fixing holder is arranged in the hollow chamber of the seal holder, and the atomization sheet is fixed on the atomization sheet fixing holder;

wherein a side wall of the atomization cotton is sandwiched and fixed between the outer wall of the inner sleeve and the inner wall of the vertical pipe, and the bottom of the atomization cotton abuts against the atomization sheet, wherein the lower part of the vertical pipe is provided with a plurality of tobacco tar through holes, wherein the tobacco tar through holes are at positions corresponding to the side wall of the atomization cotton, and the tobacco tar through holes communicate with the tobacco tar chamber;

and wherein the air duct with the thermal insulation pipe is inserted into the hollow chamber of the inner sleeve as well as the hollow chamber of the atomization cotton.

10. The atomizer according to claim 9, wherein tobacco tar storage cotton is sleeved at a position, corresponding to the tobacco tar through holes, on the outer wall of the vertical pipe, and the tobacco tar storage cotton is located in the tobacco tar chamber and covers the tobacco tar through holes.

11. The atomizer according to claim 9, wherein the lower part of the inner chamber of the inner sleeve is sleeved with a spring, the lower end of the spring abuts against an inner surface of the bottom of the atomization cotton, and the air duct with the thermal insulation pipe is inserted into the hollow chamber of the inner sleeve as well as a central hole of the spring.

12. The atomizer according to claim 1, wherein a filter screen is arranged at the joint of the air duct and the thermal insulation pipe.

13. The atomizer according to claim 1, wherein the inner chamber of the thermal insulation pipe is conical, and the inner diameter of the upper part of the thermal insulation pipe is smaller than the inner diameter of the lower part of the thermal insulation pipe.

14. An electronic cigarette, comprising an external power source, wherein the electronic cigarette further comprises the atomizer according to claim 1, and wherein the external power source is connected to a connection electrode of the atomizer.

* * * * *